US006253844B1

(12) United States Patent
Walker

(10) Patent No.: US 6,253,844 B1
(45) Date of Patent: Jul. 3, 2001

(54) SWIVELLING DEVICE FOR A DOWNHOLE ROD PUMP, AND METHOD OF USE THEREOF

(76) Inventor: Lloyd Lewis Walker, 262 - 2nd Avenue N.E., Swift Current SK (CA), S9H 3V5

( * ) Notice: Subject to any disclaimer, the term of this patent is extended or adjusted under 35 U.S.C. 154(b) by 0 days.

(21) Appl. No.: 09/353,029

(22) Filed: Jul. 13, 1999

Related U.S. Application Data

(63) Continuation-in-part of application No. 09/160,247, filed on Sep. 25, 1998, now abandoned.

(51) Int. Cl.[7] ..... F21B 19/00

(52) U.S. Cl. ..... 166/77.51; 166/85.1; 166/98; 166/377

(58) Field of Search ..... 166/377, 77.51, 166/85.1, 77.52, 98, 241.2; 294/82.1

(56) References Cited

U.S. PATENT DOCUMENTS

| | | | | |
|---|---|---|---|---|
| 2,075,426 | * | 3/1937 | Church | 285/36 |
| 2,633,333 | * | 3/1953 | Storm | 173/151 |
| 3,949,818 | * | 4/1976 | Russell | 175/52 |
| 4,074,519 | * | 2/1978 | Garrett | 59/95 |
| 4,128,127 | | 12/1978 | Taylor . | |
| 4,669,907 | * | 6/1987 | Patton | 403/78 |
| 4,911,579 | | 3/1990 | Lutz et al. . | |
| 5,352,056 | * | 10/1994 | Chandler | 403/79 |
| 5,529,421 | | 6/1996 | Epkens . | |
| 5,697,768 | | 12/1997 | Mills . | |
| 5,711,386 | | 1/1998 | Swietlik . | |
| 5,743,576 | | 4/1998 | Schron, Jr. et al. . | |
| 5,772,350 | | 6/1998 | Ferguson et al. . | |

FOREIGN PATENT DOCUMENTS

| | | |
|---|---|---|
| 1157459 | 11/1983 | (CA) . |
| 2117968 | 10/1994 | (CA) . |

* cited by examiner

*Primary Examiner*—David Bagnell
*Assistant Examiner*—Jennifer R. Dougherty

(57) ABSTRACT

The invention provides a back spin swivelling device for a downhole rod pump, for backing off drive strings which may be under torque. The device of the invention is particularly suited for use with progressive cavity pumps (PCP), and for the release of torque in a drive string through "back spin". The device comprises a housing having an opening at a bottom end adapted to receive a rotatable shaft and having means for attachment to an external support at a top end; said rotatable shaft being partially housed within the housing and projecting from the bottom end of the housing, the shaft having at its bottom end means for attachment to a drive string; and means for mounting the shaft rotatably within the housing. The shaft and the means for attachment to the drive string are substantially symmetrical about their common axis of rotation, and provide no point of articulation between the shaft and the drive string. In a preferred embodiment, the device includes shock absorbing means for damping longitudinal displacements of the shaft. The symmetrical design of the rotating parts and the linear attachment of the shaft to the drive string greatly improve the safety of the device in comparison with rod pulling devices of the prior art, avoiding equipment failure and possible injury due to flying apart of the device under the influence of "wobble" at high angular velocities.

17 Claims, 2 Drawing Sheets

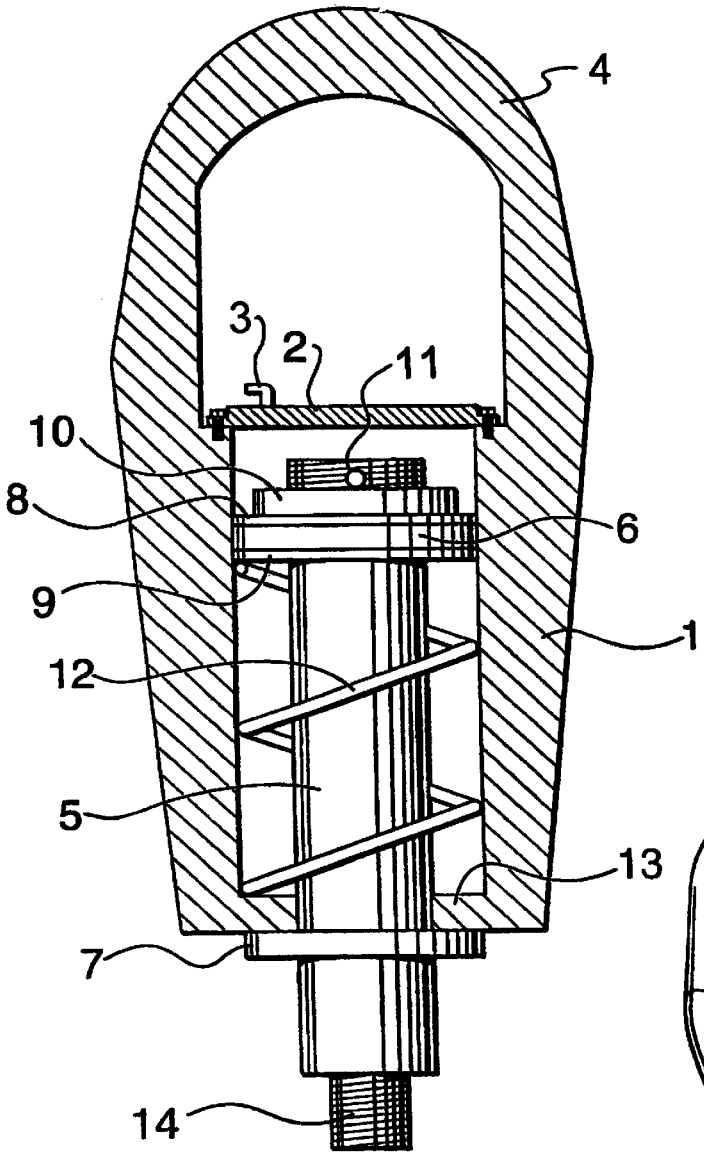
FIG. 1
Fig. 2B
(Prior Art)
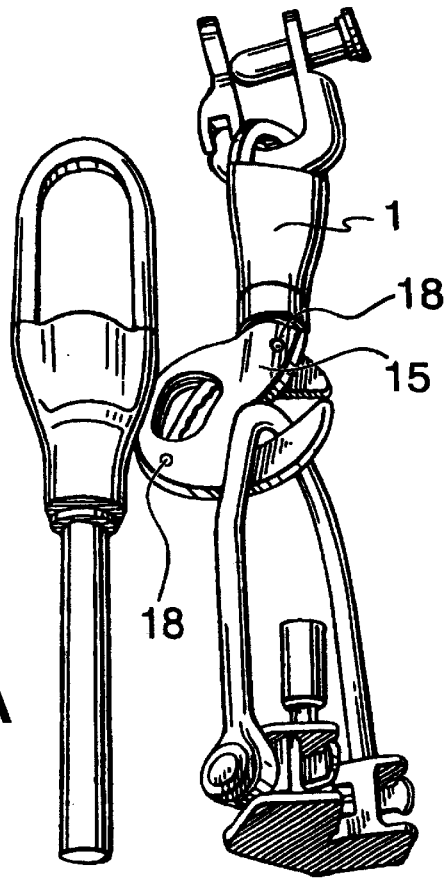
Fig. 2A

SWIVELLING DEVICE FOR A DOWNHOLE ROD PUMP, AND METHOD OF USE THEREOF

CROSS-REFERENCE TO RELATED APPLICATION

This application is a continuation in part of Applicants' U.S. patent application Ser. No. 09/160,247, filed Sep. 25, 1998 (now abandoned).

BACKGROUND OF THE INVENTION

Field of the Invention

The present invention is directed to a swivelling device for pulling pump drive strings which may be under torque.

Downhole rod pumps, particularly rotary pumps such as progressive cavity pumps (PCP), and stroke pumps, are generally driven by a drive string which extends through a concentrically arranged production tubing string. The drive string is made up of a plurality of rods or tubes which are connected together end-to-end by rod boxes. Alternatively the drive string may consist of one continuous rod cut and pinned to the desired length.

Progressive cavity pumps generally include a stator affixed to the production tubing and a corkscrew-shaped rotor connected to and supported at the working end of the drive string. The drive string is connected at its top end to a smooth rod, called a polish rod, which allows an effective seal to be created between the outer production tubing and the inner drive string. The polish rod is attached to a drive unit which, in operation, rotates the drive string. Upon actuation of the pump by rotation of the drive string, fluids are forced to the ground surface through an annular space provided between the drive string and the production tubing.

In operation, often the working end of a drive string will become jammed by such things as accumulation of debris, too high viscosity of the surrounding medium, or obstructions in the pump hole. When this happens with a rotary pump the end of the drive string may stop rotating, but the polish rod and remaining rods of the drive string continue to rotate until the drive unit is stopped by overload sensors; then a braking system that is built into the drive unit controllably releases back spin. The rotation of the drive string without rotation of its end causes the accumulation of torque, through twisting of the drive string. The accumulated torque, which may be substantial, due to the length of the drive string, may be released by "back spin", spinning the drive unit backwards. Under normal circumstances, the braking system releases in a controlled manner, thereby allowing the release of the torque accumulated in the drive string by "back spin". However, if the braking system locks on solid, the accumulated torque may be released uncontrolled once a drive clamp is disconnected from the drive unit by picking the polish rod up a few centimeters. The back spin is then released in an uncontrolled manner. In conventional systems, to pull the drive string and release torque, the drive unit is disconnected and the polish rod attached to a pony rod, a rod elevator and a rod hook. The rod hook contains a swivel which allows the drive string to "back spin", for the release of accumulated torque. Such conventional rod pulling devices, using a rod hook connected to a polish rod by a rod elevator, are not symmetrical along the axis of rotation. This means that the known devices are prone to "wobble", which can lead to stress under the high angular velocities attained when back spin is released uncontrolled. The "wobble" is exacerbated by the fact that the rod elevator and the rod hook form a point of articulation which can bend under the centrifugal force of rotation, allowing the bottom of the hook and the top of the elevator to "swing out" from the axis of rotation. The point of articulation between the rod elevator and the rod hook is a common cause of failure. Conventional devices also have moving parts for attaching the elevator to the rod hook, in the form of a locking finger on a hook portion of the rod hook, which is usually spring biassed in a closed position. The moving parts complicate the manufacture and assembly of the device, and provide weak points for failure. These factors contribute to make conventional rod pulling devices extremely unstable under conditions of high angular velocities, such as are encountered in the release of back spin. The conventional devices may fail during use, leading to equipment damage and human injury when the components fly apart.

Pumps other than rotary pumps, such as a stroke pump, may become sanded in or stuck. If this situation occurs the only way to pull the pump rod string out of the hole is to strip it out. This is achieved conventionally by installing tubing tongs over the rod string. A device called a "back off tool" is then clamped to the rod string. The tubing tongs are then used to rotate the back off tool and rod string. The rod string then backs off at the weakest connection. The swivel is then removed and a rod hook and elevator are installed for pulling off the rods. If there is no tubing drain, the fluid inside the tubing (surrounding the rod string) must then be swabbed out down to the top of the remaining rods (i.e. the rods below the weakest connection). Once this is achieved the tubing is pulled out of the hole to the remaining rods. The back off procedure is repeated until all rods and tubing are removed from the well.

Because the rods are backed off at the weakest connection the sudden rotation of the rods and/or torque created to back the rods off often causes the rod to jump violently. On some occasions the elevator can jump out past a safety latch of the rod hook, dropping the elevator onto the tubing tongs, causing equipment damage or possible injury to the working crew. The torque generated to back the rods off varies from type of pump, for example PCP (which rotates to the right under normal conditions) to a rod pump on a pump jack which strokes up and down. The pump jacks are not usually as tight requiring less torque to back the rods off, but still require substantial torque. The sudden back off causes sudden and very quick back spin that usually lasts a few seconds.

The conventional method for backing off of a rod pump on a pump jack is therefore dangerous, and suffers the same drawbacks as mentioned above for backing off of a rotary pump.

The "flush by" is a frequent procedure with PCP pumps. PCP pumps may need to be flushed because of debris causing the rotor to become sticky or the fluid may become too thick or heavy for the pump to force it to the ground's surface. A flush by is achieved by picking the polish rod up a few centimeters to unlock the polish rod clamp from the drive unit. Fluid is then pumped down the annular space between the production tubing the drive string; this causes the drive string to rotate backward, i.e. "back spin". The back spin may be very fast, for long periods of time causing equipment to fly apart.

BRIEF SUMMARY OF THE INVENTION

The present invention provides a safe and easy to use swivelling device for use with a rod bottom hole pump.

In accordance with one aspect of the present invention there is provided a swivelling device for a rod bottom hole pump for connection to a drive string, comprising a housing having an opening at a bottom end, and having means for attachment to an external support at a top end; a rotatable shaft being partially housed within the housing, extending through the opening, and projecting from the bottom end of the housing, the shaft having at its bottom end means for attachment to the drive string; and means for mounting the shaft rotatably within the housing, the means for mounting being enclosed in the housing; wherein the shaft and means for attachment to the drive string are substantially symmetrical about their common axis of rotation, and provide no point of articulation between the shaft and the drive string.

In accordance with another aspect of the present invention there is provided a method for backing off a drive string in a rod bottom hole pump, comprising attaching a rotatable shaft to the drive string, wherein the shaft is attached to the drive string symmetrically about the axis of rotation of the shaft, and there is no point of articulation between the shaft and the drive string, and wherein a top end of the shaft is enclosed in a housing; and pulling on the drive string while allowing the shaft to rotate in response to torque in the drive string.

DETAILED DESCRIPTION OF PREFERRED EMBODIMENTS

The invention will be described in terms of a device for backing off a rod bottom hole pump (a rod bottom hole pump being any pump which operates by a drive string), particularly for releasing back spin in a progressing cavity pump, or for backing off a stroke pump, however it is to be understood that the device of the invention extends to use in any application in which it is desired to lift a load which is under torque, which rotates, or which it is desired to rotate.

The device of the present invention allows the pulling of a drive string and if necessary the release of back spin, with considerably enhanced safety when compared to known devices. The use of a housing for the shaft and bearings confers enhanced stability, even under conditions of high angular velocity. A number of connections are eliminated, thus decreasing possible failure points. The symmetry of the rotating elements about the axis of rotation, and the lack of any point of articulation between the shaft and the drive string mean that the device provides a straight direct pull, when pulling a drive string, decreasing "wobble" during rotation, which in turn decreases stress.

In use with a progressive cavity pump, the shaft of the device is attached to the drive string by a polish rod. The device reduces polish rod burn scratches and scoring damage to the drive unit. The enclosure of all the rotating parts of the device, with the exception of the bottom end of the shaft, means that in the event of failure the components are unlikely to fly out and cause injury and equipment damage. The device may optionally include shock absorbing means for damping longitudinal displacements of the shaft caused by vibrations and longitudinal displacements of the shaft caused by movements of the drive string, which can be abrupt and are often the cause of "wobble" in conventional rod hooks, leading to failure. The device of the invention eliminates the need for a pony rod, rod elevator and rod hook, all of which are potential points of failure of conventional devices.

The housing is adapted at its top end for attachment to a support. For this purpose, the top end of the housing may, for example, be in the form of a ring or loop, through which a hook or other support means may be passed. If desired, the top end of the housing can be closed, for example, by a dust cap.

The shaft is rotatably mounted in the housing. In a preferred embodiment the shaft can move longitudinally in response to vibrations and abrupt movements of the drive string. A preferred means for mounting the shaft is by using a floating bearing. It is particularly preferred to use a floating flat roller bearing. If desired, a stopper ring can be placed about the bottom portion of the shaft, below the housing, to prevent the shaft from rising too high in the housing. In a preferred embodiment, the stopper ring is machined into, and forms part of the shaft. For safety reasons, it is preferred to have a stopper ring. The swivelling device is often required to pull heavy weights, and if the polish rod should become suddenly inadvertently detached and there is no stopper ring, the shaft can shoot out through the top of the device.

For the purpose of stability, it is preferred that the greater part of the shaft be within the housing.

For use with a rotary pump such as a progressive cavity pump the shaft is provided, at its bottom end, with means for attaching to a polish rod. The attachment means can be any means which does not deviate substantially from symmetry about the common axis of rotation of the shaft and the attachment means, and which does not provide a point of articulation between the shaft and the polish rod (i.e. the shaft and the attachment means, when attached to the polish rod, cannot bend significantly from the axis of rotation under the influence of centrifugal or other forces inclined to the axis of rotation). This avoids the disadvantageous arrangement found in known devices wherein the attachment means is non-symmetrical about the axis of rotation, and/or wherein the rod pulling device must be attached to the polish rod via an elevator and a pony rod. The arrangement of the known devices can lead to "wobble" during rotation. In a preferred embodiment, the shaft and the means of attachment to the polish rod are constructed as a single piece.

The attachment means can be, for example, in the form of a female socket at the end of the shaft to receive a complementary male part on the polish rod, a male part on the end of the shaft to be received by a complementary female socket on the polish rod, or a screw thread on the end of the shaft to be received by a complementary screw thread on the polish rod. In the case of a PCP, it is preferred that the attachment means be a screw thread fitting provided at the bottom end of the shaft, which can be fitted into a complementary screw thread fitting on a polish rod. The screw thread on the shaft can be female or male.

Preferably the attachment means attaches directly to the polish rod, although connection through adaptors is also possible, provided the adaptors are also symmetrical about the axis of rotation, and provide no point of articulation between the shaft and the polish rod.

The attachment of the device of the invention directly or through adaptors to a polish rod means that there is no need for the use of a rod hook, rod elevator and pony rod. This eliminates a point of articulation between the rod hook and the rod elevator. This point of articulation is a source of "wobble" causing polish rod burn and wear, and increasing the change of equipment failure.

In the case of other rod pumps, such as a stroke pump, the device can be attached to the drive string by screwing onto a thread on the polish rod of the drive string. If the rod string pin thread is different from that of the device, an adapter can be used.

Another situation in which the device of the invention is useful is in "flushing by" or "pumping by". Flushing by is an additional procedure for freeing a rod string that has become jammed. The rod string is backed off slightly, as described previously, and fluid is pumped under pressure into the space between the rod string and the outer tubing surrounding the rod string, in order to dislodge debris which may have caused the rod string to jam. Usually, when the debris dislodges, the rod string will abruptly move, under either applied torque, in the case of a stroke pump, or accumulated torque, in the case of a rotary pump. Again, the device of the invention allows the torque to be released without the hazards associated with traditional tools used for backing off, such as rod tongs and a rod elevator.

In a preferred embodiment, the device is provided with shock absorbing means for damping longitudinal displacements of the shaft. The shock absorbing means can, for example, be provided by a hydraulic shock absorber or a spring or a plurality of springs. It is preferred to use a spring, particularly a coiled spring. It is particularly preferred to use a coiled spring, with the shaft passing through the longitudinal axis of the helix of the spring.

The materials which may be used to construct the device of the invention are limited only in that they must be of sufficient strength to lift the required load, and to withstand the angular momentum generated by rotation. For a PCP, it is preferred to use steel for the housing and the shaft.

A particularly preferred embodiment will be described with reference to the figures, which depict:

BRIEF DESCRIPTION OF THE DRAWINGS

FIG. 1 shows a partially cut-away view of a device of the invention.

FIG. 2A shows a device of the invention.

FIG. 2B shows a conventional rod hook, elevator and pony rod.

Figure 3:
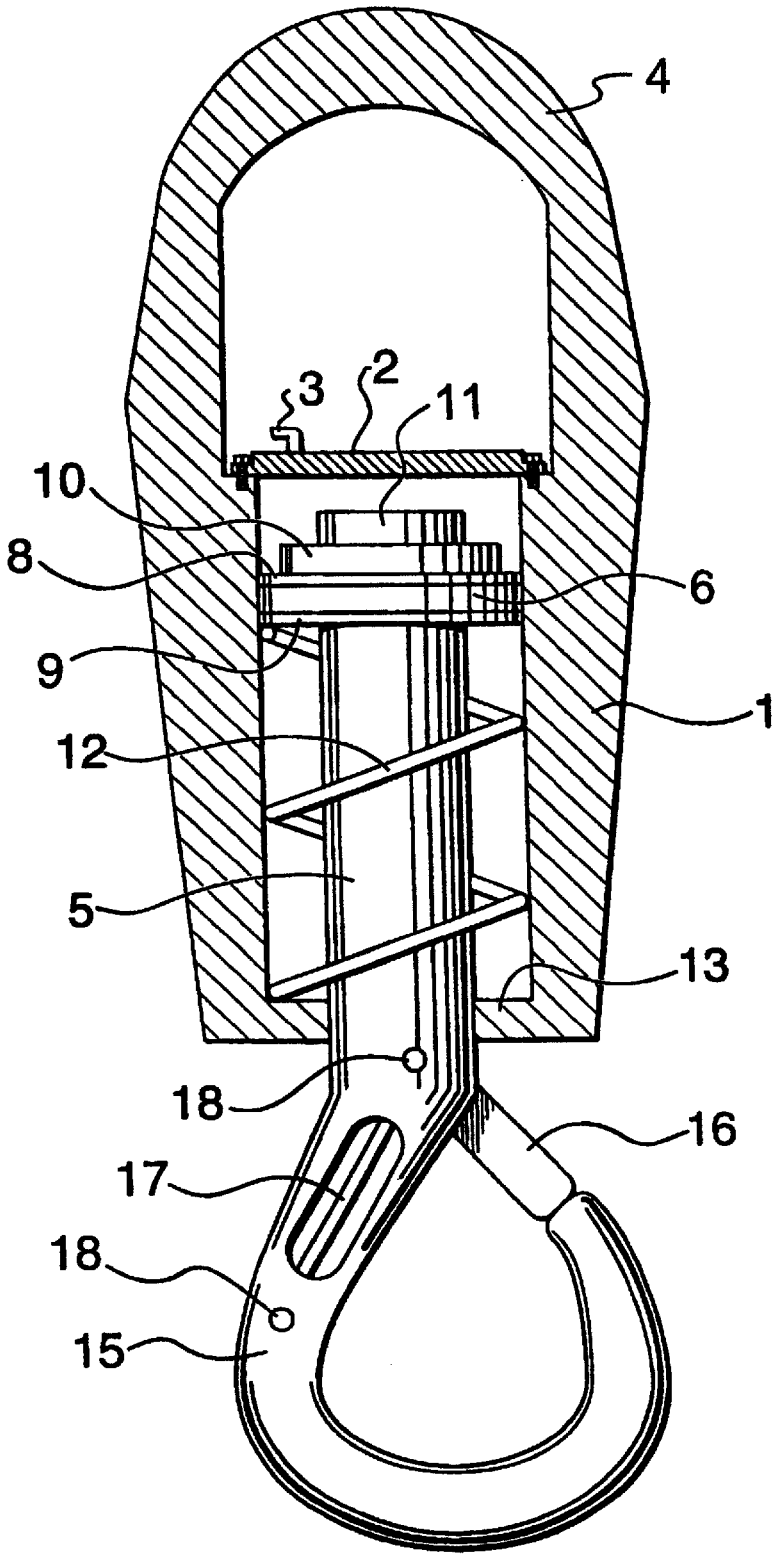
FIG. 3 (Prior Art)
FIG. 3 shows a partially cut-away view of a rod hook of the prior art.

In the preferred embodiment of a device of the invention depicted in FIG. 1, the housing (1) is an approximate cylinder, closed at the top end by means of a dust cap (2), with a grease nipple (3) disposed for easy lubrication of the device. The housing (1) has a loop shaped handle (4), which, in use, is attached to support means. The shaft (5) is rotatably mounted in the housing (1) by means of a floating flat roller bearing (6). A stopper ring (7) about the bottom portion of the shaft (5), of greater diameter than the opening at the bottom of the housing, prevents the shaft from rising above a height in the housing (1) at which the stopper ring (7) abuts the bottom end of the housing (1). The floating flat roller bearing (6) is sandwiched between two washers (8, 9). About the shaft, above the washer (8) is placed a lock nut (10). The top portion of the shaft (5) is provided with a safety pin (1) for the lock nut (10) that sits above the lock nut (10). A coiled spring (12) surrounds the shaft (5) and abuts at its top end the bottom washer (9). The bottom end of the spring (12) abuts a ridge (13) that is provided on the inside of the bottom end of the housing. Although in the embodiment depicted the spring sits below the floating bearing, it can equally well sit above the floating bearing, in which case means must be provided at the top of the housing to abut the top end of the spring. In other embodiments the shock-absorbing means is provided by a plurality of springs, which abut the floating bearing without the shaft passing through their coils. The spring provides shock absorbing means for damping longitudinal displacements of the shaft caused by vibrations and abrupt movements of a load attached to the shaft (5). The shaft is provided at its bottom end with a male screw thread fitting (14), which, in operation, is attached to a corresponding female screw thread fitting on a polish rod of a drive string.

In operation, in use with a rotary pump, such as a progressive cavity pump the screw thread on the shaft is fitted to a polish rod attached to the back end of a drive string. The shaft rotates when the drive string rotates. The rotation of the shaft permits the release of torque in the drive string through back spin. Abrupt longitudinal movements of the drive string and vibrations are absorbed by the spring. The spring allows the gentle picking up of a load, such as a polish rod attached to a drive string. The device minimizes "wobble". The minimization of wobble greatly decreases the chances of failure due to centrifugal force. The housing ensures that all rotating parts are enclosed, so that in the event of failure the parts are unlikely to fly out causing injury and equipment damage. The use of means for attachment directly to the polish rod eliminates the need for a pony rod, and a rod elevator which contribute to "wobble" during rotation, and which provide weak points for failure during high speed rotation.

In operation in use with a rod pump other than a progressive cavity pump, the screw thread on the shaft is fitted to a complementary screw thread, either on the drive string itself, or on an adapter suitable to be connected to the drive string. The rods of the drive string are then backed off, and any abrupt motions of the drive string are absorbed either by the rotation of the shaft, or the damped longitudinal movement of the shaft.

In FIG. 3, a rod hook of the prior art is shown. It shares some features with the device of the invention, however in the prior art device, the rotatable shaft (5) terminates at its bottom end in a hook (14 ). In use, the hook (15) is attached to a rod elevator (not shown), which is attached to a polish rod via a pony rod (both not shown). As can be seen from FIG. 3, the hook (15) is unsymmetrical in shape and mass about the axis of rotation. It furthermore comprises two moving parts: the locking finger (16), and the lock releasing latch (17), which are possible points of failure, and provide small parts which may fly out under the influence of centrifugal force, or abrupt longitudinal movements. When attached to the rod elevator a point of articulation is formed between the rod hook and the rod elevator (i.e. bending out of the axis of rotation is possible between the rod hook and the elevator). This point of articulation permits the bottom of the rod hook and the top of the elevator to "swing out" under the influence of centrifugal force during rotation. This leads to stress on the device, with possible failure. The use of a rod elevator further increases the likelihood of failure. Most rod elevators comprise several moving parts with inherent weaknesses at their points of connection.

FIG. 2A shows the device of the invention, and FIG. 2B shows a conventional arrangement on the right. The top half of the conventional arrangement consists of a rod hook, as shown in FIG. 3. The rod hook shown in FIG. 2 has roll pins (18). The top roll pin allows the pivoting of the locking finger (16), and the bottom roll pin allows the pivoting of the releasing latch (17). The roll pins can fly out or release during back spin, with consequent equipment damage or user injury.

The lower half of the conventional arrangement in FIG. 2B consists of a rod elevator.

I claim:

1. A swivelling device adapted for connection to a drive string of a downhole rod pump, the device comprising;

a housing having an opening at a bottom end, and having means for attachment to an external support at a top end, said means for attachment to said external support being rigidly fixed to said housing without possibility of relative movement there between;

a rotatable shaft having most of its length housed within the housing, and extending through the opening and projecting only from the bottom end of the housing, the shaft including an integral means for attachment to the drive string at a bottom end of the shaft, said shaft and said means for attachment to the drive string being substantially symmetrical about a common axis of rotation and being such that said means for attachment to the drive string connects to said drive string with no point of articulation between the shaft and the drive string; and means for mounting the shaft rotatably within the housing, the means for mounting being enclosed within the housing.

2. The device of claim 1, wherein the means for attachment to the drive string is a screw thread fitting on the shaft, complementary to a screw thread fitting on the drive string or a polish rod or adapter connected to the drive string.

3. The device of claim 2, wherein the screw thread fitting on the shaft is a male screw thread fitting.

4. The device of claim 1, wherein the shaft and the means for attachment to the drive string are constructed as a single piece.

5. The device of claim 1, which additionally comprises shock absorbing means for damping longitudinal displacements of the shaft.

6. The device of claim 5, wherein the shock absorbing means is a spring in communication with the shaft.

7. The device of claim 6, wherein the spring communicates at a first end of the spring with the shaft by communicating with a floating bearing.

8. The device of claim 7, wherein the floating bearing is disposed between an upper and a lower washer, both washers encircling the shaft, and the spring abuts at a first end of the spring one of the washers, thereby communicating with the shaft through the floating bearing.

9. The device of claim 8, wherein a second end of the spring abuts the inside of the bottom end of the housing.

10. The device of claim 7, wherein a second end of the spring abuts the inside of the bottom end of the housing.

11. The device of claim 6, wherein the spring is a coil spring which encircles the shaft.

12. The device of claim 1, wherein the means for mounting the shaft rotatably within the housing is a floating bearing surrounding the shaft.

13. The device of claim 1, wherein disposed about the bottom end of the shaft, below the bottom end of the housing, is a stopper ring, the stopper ring having an external diameter greater than the diameter of the opening at the bottom end of the housing, whereby, the shaft is prevented from rising within the housing above a height at which the stopper ring abuts the bottom of the housing.

14. The device of claim 13 wherein the stopper ring and the shaft are constructed as a single piece.

15. The device of claim 1, wherein the means for attachment to an external support is a ring or loop.

16. The device of claim 1, for use with a progressive cavity pump.

17. A method for backing off a drive string in a rod bottom hole pump, comprising attaching a rotatable shaft to the drive string, wherein the shaft is attached to the drive string symmetrically about the axis of rotation of the shaft, and there is no point of articulation between the shaft and the polish rod, and wherein a top end of the shaft is enclosed in a housing; and pulling on the drive string while allowing the shaft to rotate in response to torque in the drive string.

* * * * *